US009579248B1

(12) United States Patent
Volkmer et al.

(10) Patent No.: US 9,579,248 B1
(45) Date of Patent: Feb. 28, 2017

(54) PLATFORM WITH VIBRATOR PAD EMBEDDED THEREIN

(71) Applicants: Randy E. Volkmer, Kearney, NE (US); Allan J. Arnold, Kearney, NE (US)

(72) Inventors: Randy E. Volkmer, Kearney, NE (US); Allan J. Arnold, Kearney, NE (US)

( * ) Notice: Subject to any disclaimer, the term of this patent is extended or adjusted under 35 U.S.C. 154(b) by 316 days.

(21) Appl. No.: 14/444,203

(22) Filed: Jul. 28, 2014

(51) Int. Cl.
*A61H 1/00* (2006.01)

(52) U.S. Cl.
CPC ..... *A61H 1/005* (2013.01); *A61H 1/006* (2013.01); *A61H 2201/1657* (2013.01); *A61H 2203/0406* (2013.01)

(58) Field of Classification Search
CPC ..... A61H 1/001; A61H 1/005; A61H 1/006; A61H 1/0292; A61H 2201/12; A61H 2201/1207; A61H 2201/16; A61H 2201/1623; A61H 2201/1626; A61H 2201/1628; A61H 2201/163; A61H 2201/1619; A61H 2201/1621; A61H 2201/164; A61H 2201/1642; A61H 23/02; A61H 2203/04; A61H 2203/0406; A63B 3/00; A63B 22/16; A63B 2213/00; A63B 2208/02; A63B 2208/0204
See application file for complete search history.

(56) References Cited

U.S. PATENT DOCUMENTS

| | | | | |
|---|---|---|---|---|
| 4,776,581 | A * | 10/1988 | Shepherdson | A63B 5/11 4/493 |
| 6,561,991 | B2 | 5/2003 | McLeod | |
| 6,620,117 | B1 | 9/2003 | Johnson et al. | |
| 6,923,773 | B2 | 8/2005 | Leivseth | |
| 7,491,183 | B2 | 2/2009 | Dalen | |
| 7,530,960 | B2 | 5/2009 | Cook | |
| 2005/0255971 | A1 * | 11/2005 | Solomon | A61H 1/0229 482/54 |
| 2007/0219473 | A1 * | 9/2007 | Talish | A61B 5/1036 601/46 |
| 2012/0253242 | A1 * | 10/2012 | Lee | A61G 7/1015 601/35 |
| 2014/0128782 | A1 * | 5/2014 | Williamson, III | A61H 1/0266 601/23 |
| 2015/0305957 | A1 * | 10/2015 | Triplett | A61H 23/00 601/53 |

* cited by examiner

*Primary Examiner* — Quang D Thanh
(74) *Attorney, Agent, or Firm* — Dennis L. Thomte; Thomte Patent Law Office LLC

(57) ABSTRACT

The invention comprises a raised platform having a vibrator pad embedded therein. The platform has a ramp at its forward end and a raised platform portion extending forwardly from the forward end of the ramp. The vibrator pad is embedded in the raised platform portion. A vertically adjustable handrail is provided at the opposite sides of the platform. A plurality of patient restraint members are provided to enable a person to stand upright on the vibrator pad.

8 Claims, 12 Drawing Sheets

PLATFORM WITH VIBRATOR PAD EMBEDDED THEREIN

BACKGROUND OF THE INVENTION

Field of the Invention

This invention relates to a bone density vibrator pad which is embedded in a platform which is designed to support a wheelchair thereon rearwardly of the vibrator pad. More particularly, the platform of this invention has patient restraints provided thereon to support a wheelchair patient in a standing position on the vibrator pad to increase the bone density of a patient.

Description of the Related Art

Many medical personnel believe that a person may increase his/her bone density if the person is subjected to vibration. It is believed to be especially important for a paraplegic person to increase his/her bone density to strengthen the person's legs, arms, etc. to enable the person to stand or to prevent injury to the person's legs, arms, back, etc. However, to the best of Applicants' knowledge, no one working in the art has provided a platform having a bone density vibrator pad embedded therein which is accessible for a person in a wheelchair. Further, Applicants' believe that no one working in the art has provided a means for enabling such a paraplegic patient to stand upright on the vibrator pad once the wheelchair has been positioned on the platform adjacent the vibrator pad.

SUMMARY OF THE INVENTION

This Summary is provided to introduce a selection of concepts in a simplified form that are further described below in the Detailed Description. This Summary is not intended to identify key aspects or essential aspects of the claimed subject matter. Moreover, this Summary is not intended for use as an aid in determining the scope of the claimed subject matter.

An apparatus is primarily provided for increasing the bone density of a patient. The apparatus of this invention is primarily designed to increase the bone density of the patient but is believed to increase blood flow and muscle mass. The invention also provides exercise for the patient and improves the digestive system of the patient. The apparatus includes a raised platform having a rearward end, a forward end, a first side and a second side. The platform includes an inclined ramp portion at the rearward end thereof with the ramp portion having a rearward lower end and a forward upper end. The platform also includes a horizontally disposed platform portion, having rearward and forward ends, which extends horizontally forwardly from the forward upper end of the ramp portion.

A vibrator pad is embedded in the horizontally disposed platform portion adjacent the forward end of the horizontally disposed platform portion. The platform also includes an upstanding first support tube having upper and lower ends with the lower end of the first support tube being secured to the platform at the first side thereof at the first end of the horizontally disposed platform portion. The apparatus also includes an upstanding second support tube having upper and lower ends with the lower end of the second support tube being secured to the platform at the second side thereof adjacent the rearward end of the horizontally disposed platform portion. The apparatus further includes an upstanding third support tube having upper and lower ends with the lower end of the third support tube being secured to the first side of the platform at the forward end of the horizontally disposed platform portion. The apparatus also includes an upstanding fourth support tube having upper and lower ends with the lower end of the fourth support tube being secured to the second side of the platform adjacent the forward side of the horizontally disposed platform portion.

A first safety arm is pivotally secured to the first support tube below the upper end thereof with the first safety arm being selectively pivotally movable between open and closed positions. The first safety arm, when in the closed position, extends inwardly towards the second side of the platform. A second safety arm is pivotally secured to the second support tube below the upper end thereof with the second safety arm being selectively pivotally movable between open and closed positions. The second safety arm, when in the closed position, extends towards the first side of the platform.

The platform also includes a first hand rail support having upper and lower ends with the lower end of the first hand rail support being selectively vertically adjustably received by the upper end of the first support tube. A second hand rail support is also provided which has upper and lower ends, with the lower end of the second hand rail support being selectively vertically adjustably received by the upper end of the second support tube. A third hand rail support having upper and lower ends is provided with the lower end of the third hand rail support being selectively vertically adjustably received by the upper end of the third support tube. A fourth hand rail support is also provided which has upper and lower ends with the lower end of the fourth hand support being selectively vertically adjustably received by the upper end of the fourth support tube. An elongated first rail, having rearward and forward ends, is secured to the upper ends of the first and second support tubes. An elongated second hand rail, which has rearward and forward ends, is secured to the upper ends of the third and fourth hand rail supports.

An elongated and horizontally disposed first slide bar having rearward and forward ends has its rearward end secured to the first hand rail support. The first slide bar is secured to the third hand rail support so that the forward end of the first slide bar extends beyond the third hand rail support. An elongated and horizontally disposed second slide bar having rearward and forward ends has its rearward end secured to the second hand rail support. The second slide bar is secured to the fourth hand rail support below the second hand rail so that the forward end of the second slide bar extends forwardly beyond the fourth hand rail support.

A first slide member is selectively longitudinally adjustably slidably mounted on the first side bar and a second slide member is selectively longitudinally adjustably slidably mounted on the forward end of the first slide bar.

A third slide member is selectively longitudinally adjustably slidably mounted on the second slide bar at the forward end thereof. A fourth slide member is selectively longitudinally adjustably slidably mounted on the second slide bar at the forward end thereof. A first patient restraint member is selectively removably secured to the first and second slide members and extends therebetween.

An upstanding fifth support tube having upper and lower ends has its lower end secured to the second slide member for longitudinal movement therewith. An upstanding sixth support tube, having upper and lower ends, has its lower end secured to the fourth slide member. A second patient restraint member is selectively removably secured to the second and fourth slide members and extends therebetween.

A third patient restraint member is secured to the third and fourth hand rail supports and extends therebetween. In the preferred embodiment, the first and third hand rail supports are selectively vertically adjustably mounted on the first and third support tubes. In the preferred embodiment, the second and fourth hand rail supports are selectively vertically adjustably mounted on the second and fourth support tubes. In the preferred embodiment, the second patient restrain member is selectively vertically adjustably mounted on the fifth and sixth support tubes. In the preferred embodiment, the third patient restraint member is selectively vertically adjustable.

It is therefore a principal object of the invention to provide a wheelchair accessible platform having a vibrating pad embedded in the upper surface thereof.

A further object of the invention is to provide an apparatus of the type described which prevents a wheelchair from rolling off the platform.

A further object of the invention is to provide an apparatus of the type described which enables a wheelchair patient to be supported in an upright position on a vibrating pad on a platform.

A further object of the invention is to provide an apparatus of the type described which enables a wheelchair patient to move upwardly onto a platform having a vibrating pad embedded thereon.

A further object of the invention is to provide an apparatus of the type described which is economical of manufacture, durable in use and aesthetic in appearance.

These and other objects will be apparent to those skilled in the art.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

DESCRIPTION OF THE PREFERRED EMBODIMENT

Figure 1:
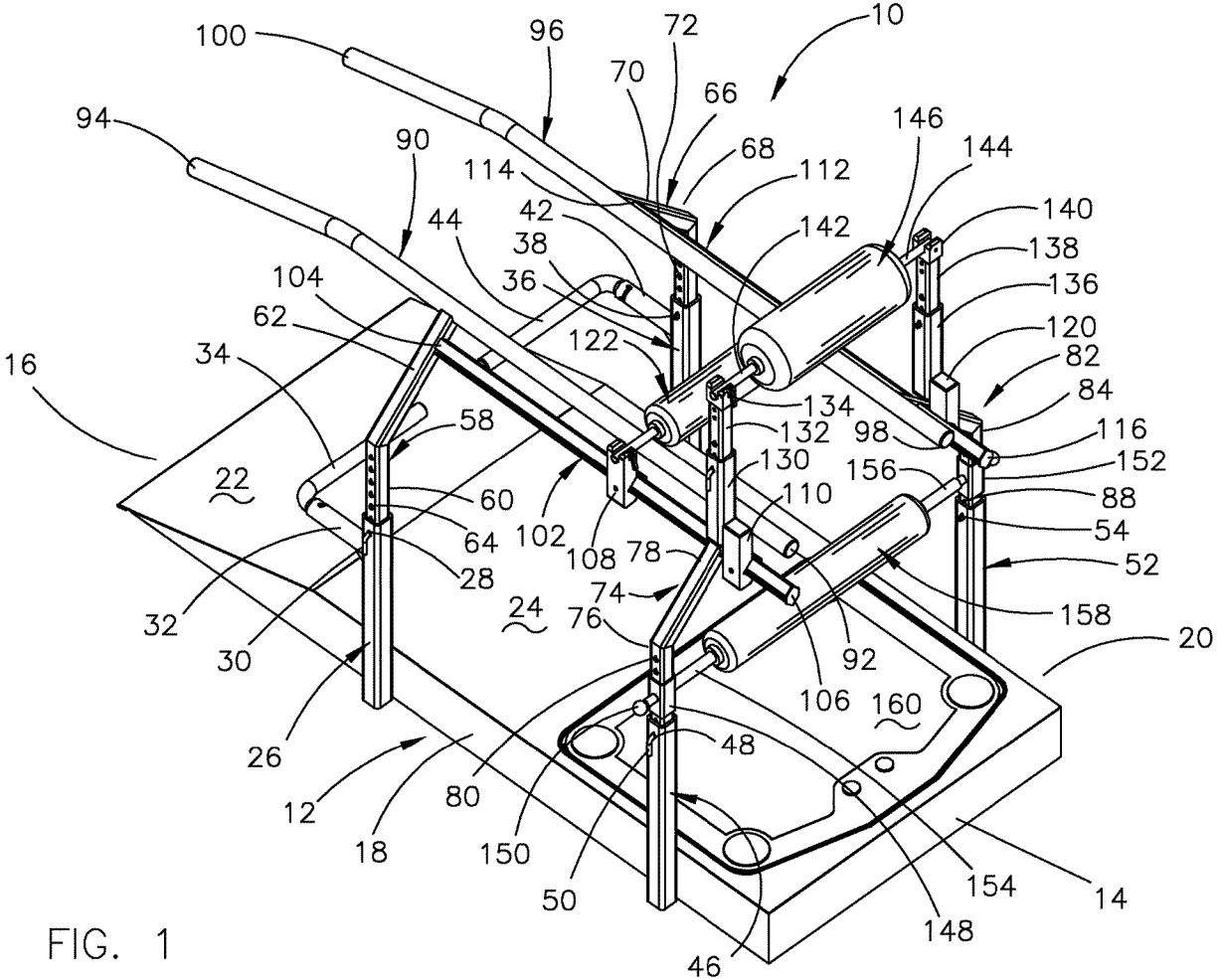
FIG. 1 is a perspective view of the instant invention.
Figure 2:
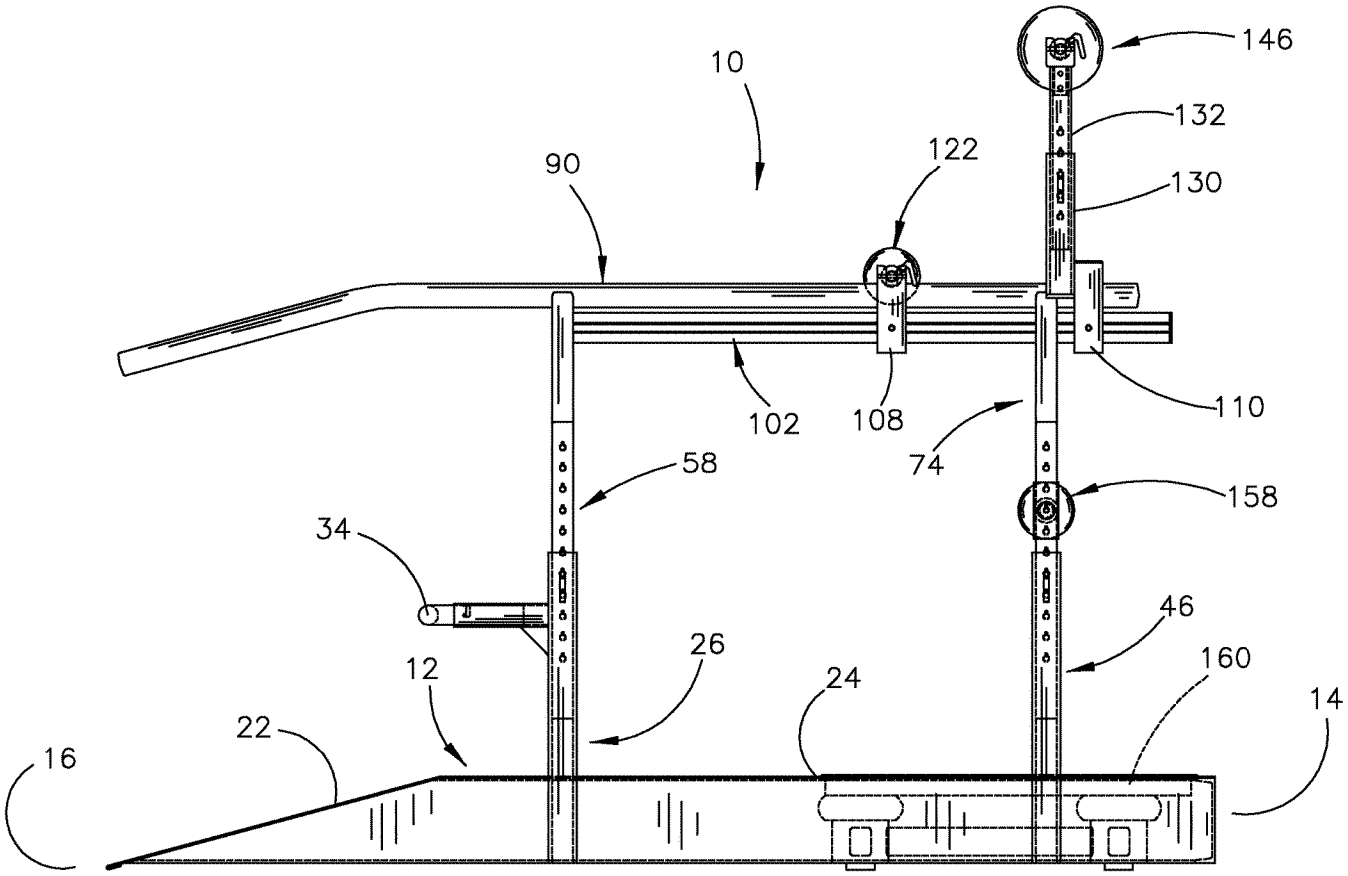
FIG. 2 is a side elevational view of the instant invention.
Figure 3:
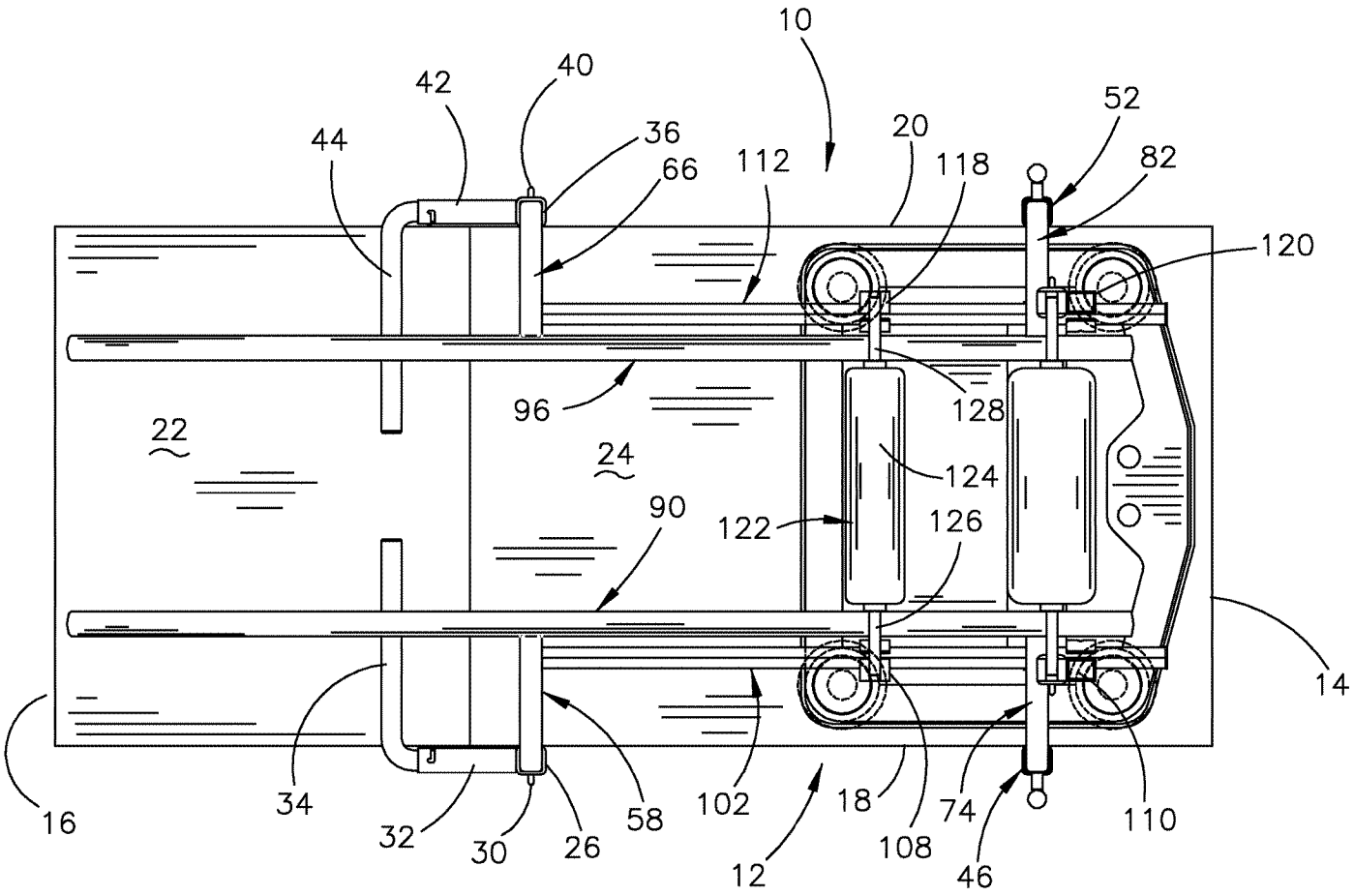
FIG. 3 is a top view of the instant invention.
Figure 4:
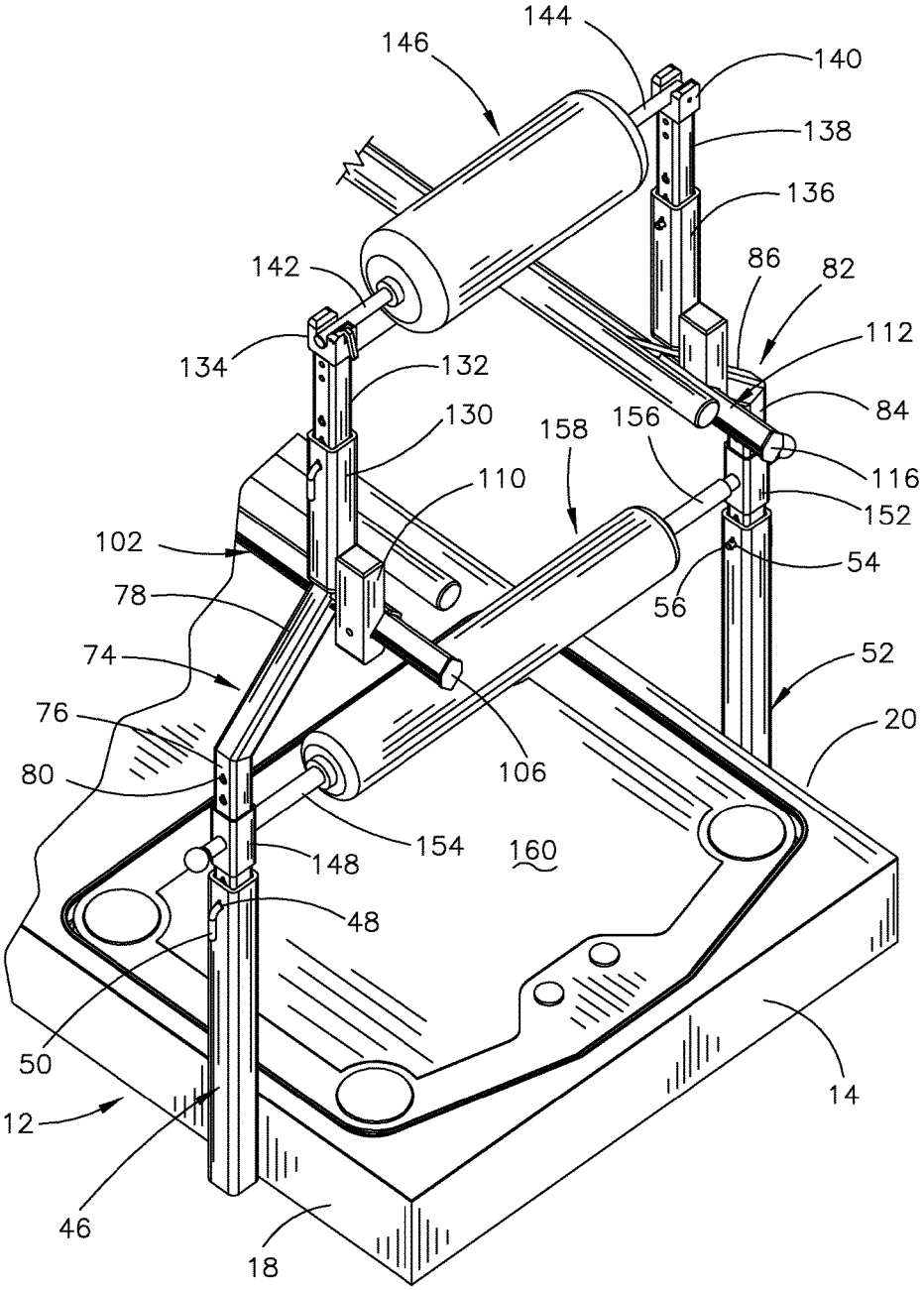
FIG. 4 is a partial perspective view of the forward end of the instant invention.

Embodiments are described more fully below with reference to the accompanying figures, which form a part hereof and show, by way of illustration, specific exemplary embodiments. These embodiments are disclosed in sufficient detail to enable those skilled in the art to practice the invention. However, embodiments may be implemented in many different forms and should not be construed as being limited to the embodiments set forth herein. The following detailed description is, therefore, not to be taken in a limiting sense in that the scope of the present invention is defined only by the appended claims.

The numeral 10 refers to the apparatus of this invention for primarily increasing the bone density of a patient. Apparatus 10 includes a raised platform 12 which is generally rectangular in shape and which has a forward end 14, a rearward end 16, a first side 18 and a second side 20. Platform 12 includes an inclined ramp 22 at its rearward end which terminates in a horizontally disposed and raised platform portion 24.

Figure 5:
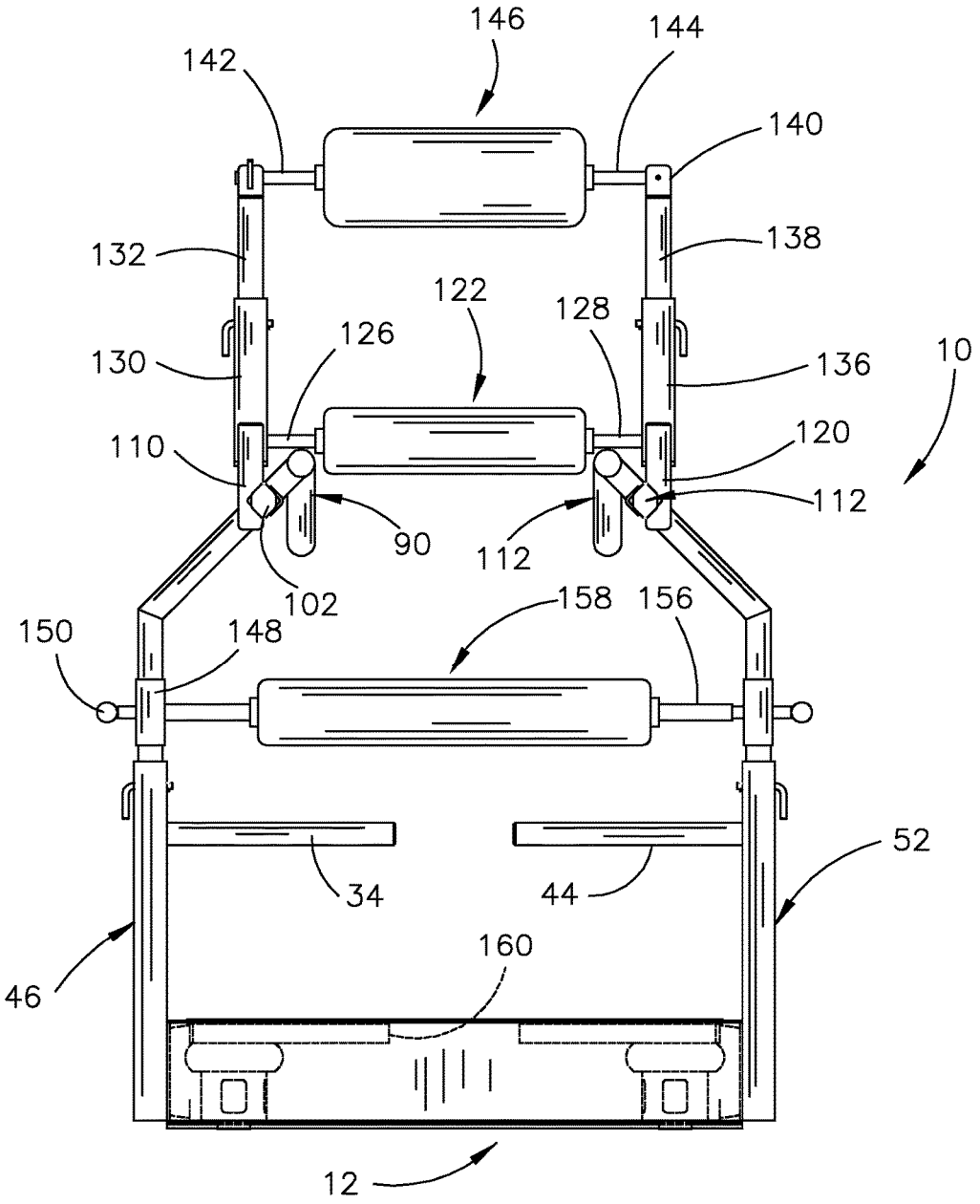
FIG. 5 is a front elevational view of the instant invention.
Figure 6:
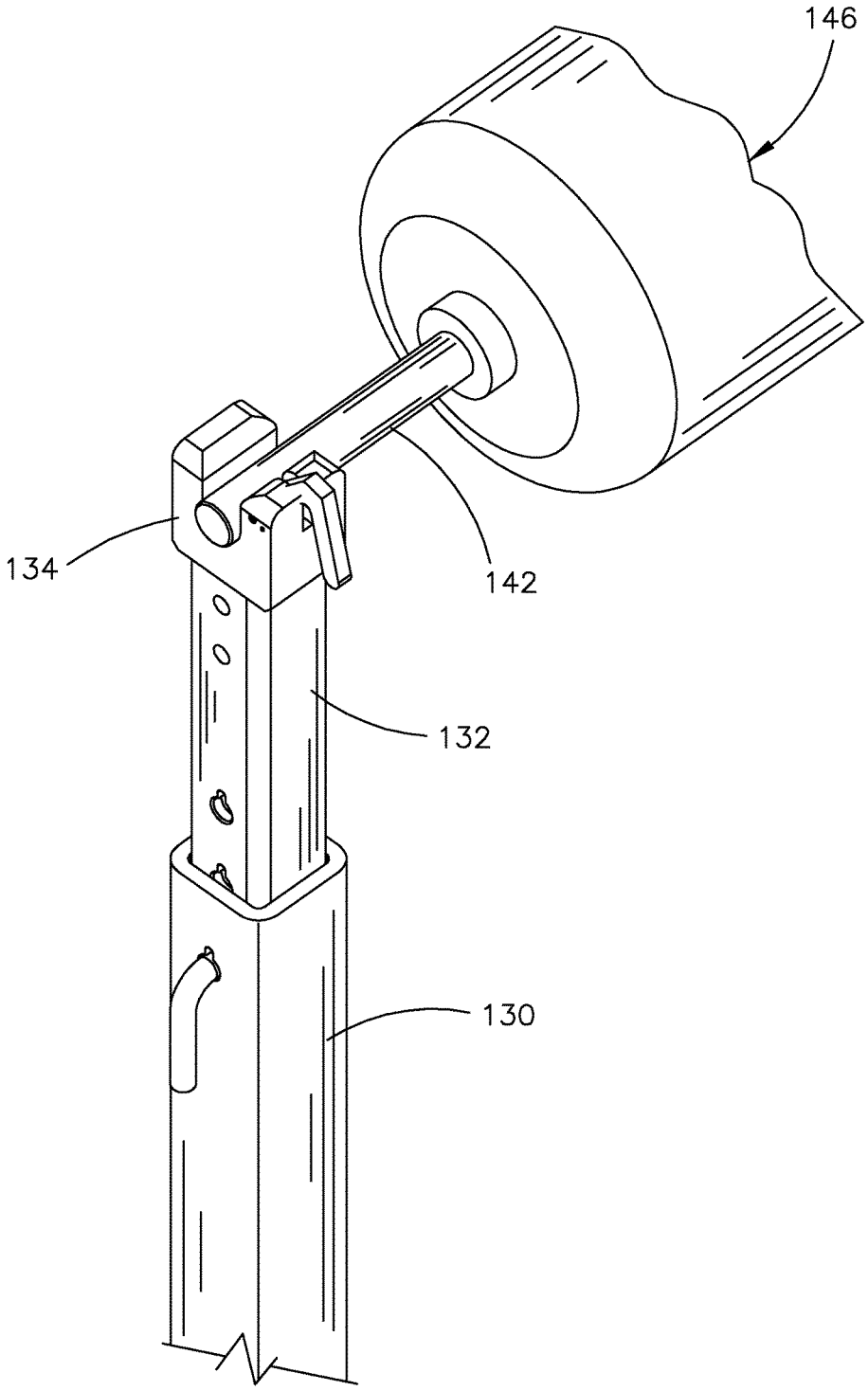
FIG. 6 is a partial perspective view of the instant invention.
Figure 7:
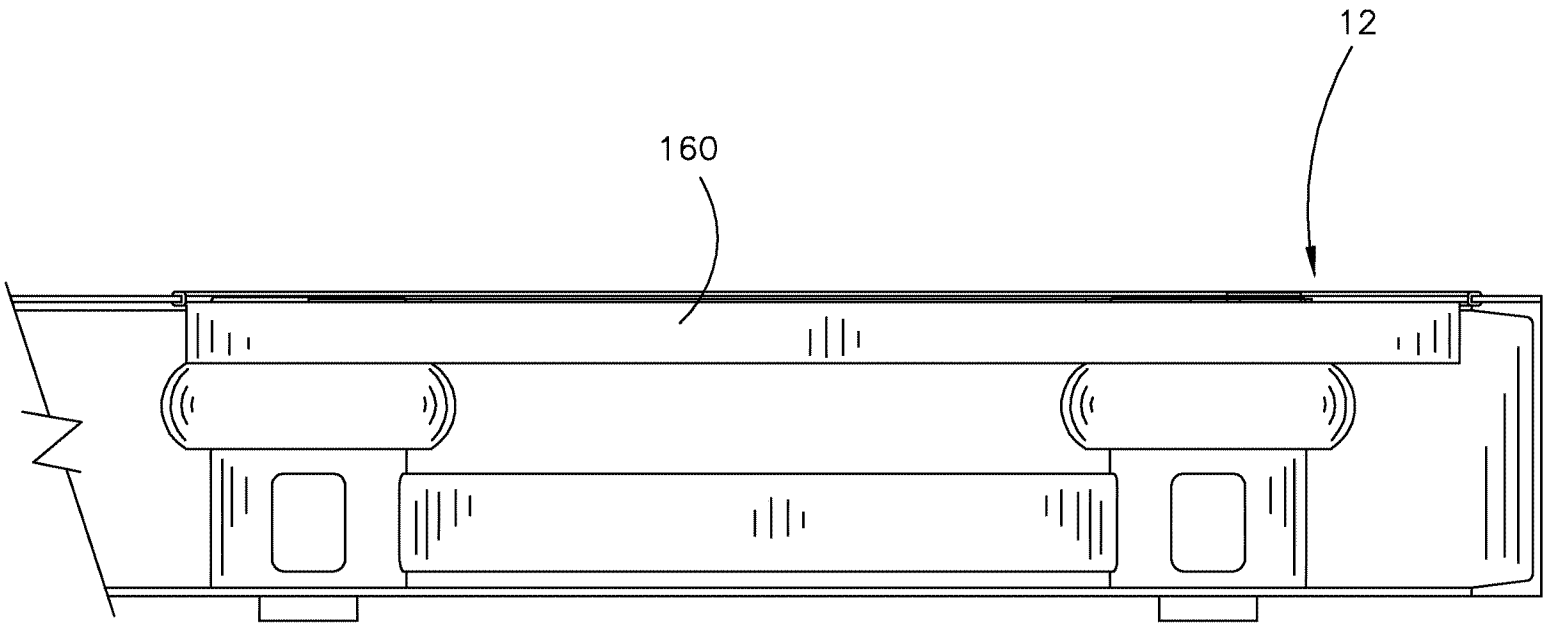
FIG. 7 is a partial side view of the instant invention.
Figure 8:
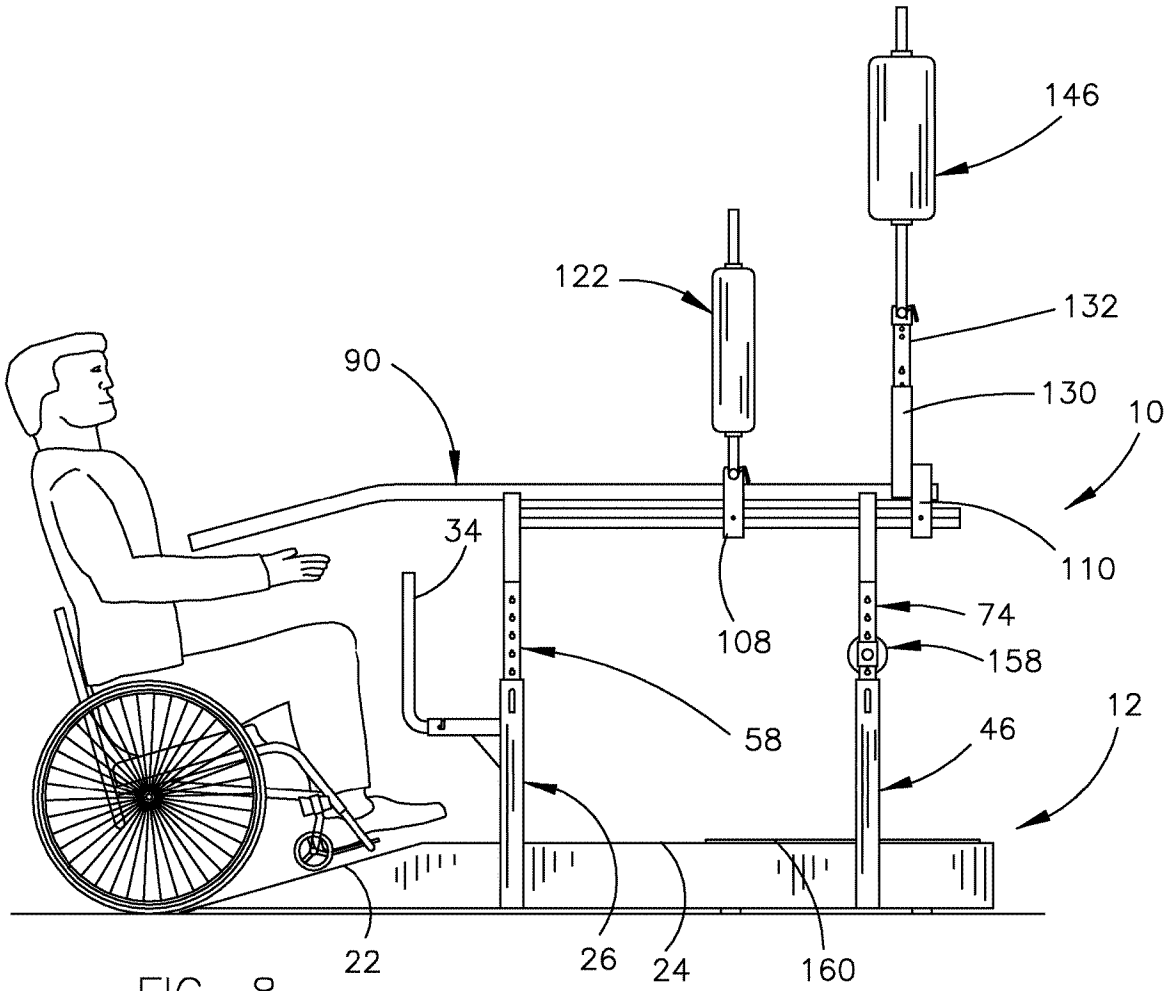
FIGS. 8-12 are sequential side views illustrating the manner in which a patient in a wheel chair uses the instant invention.
Figure 9:
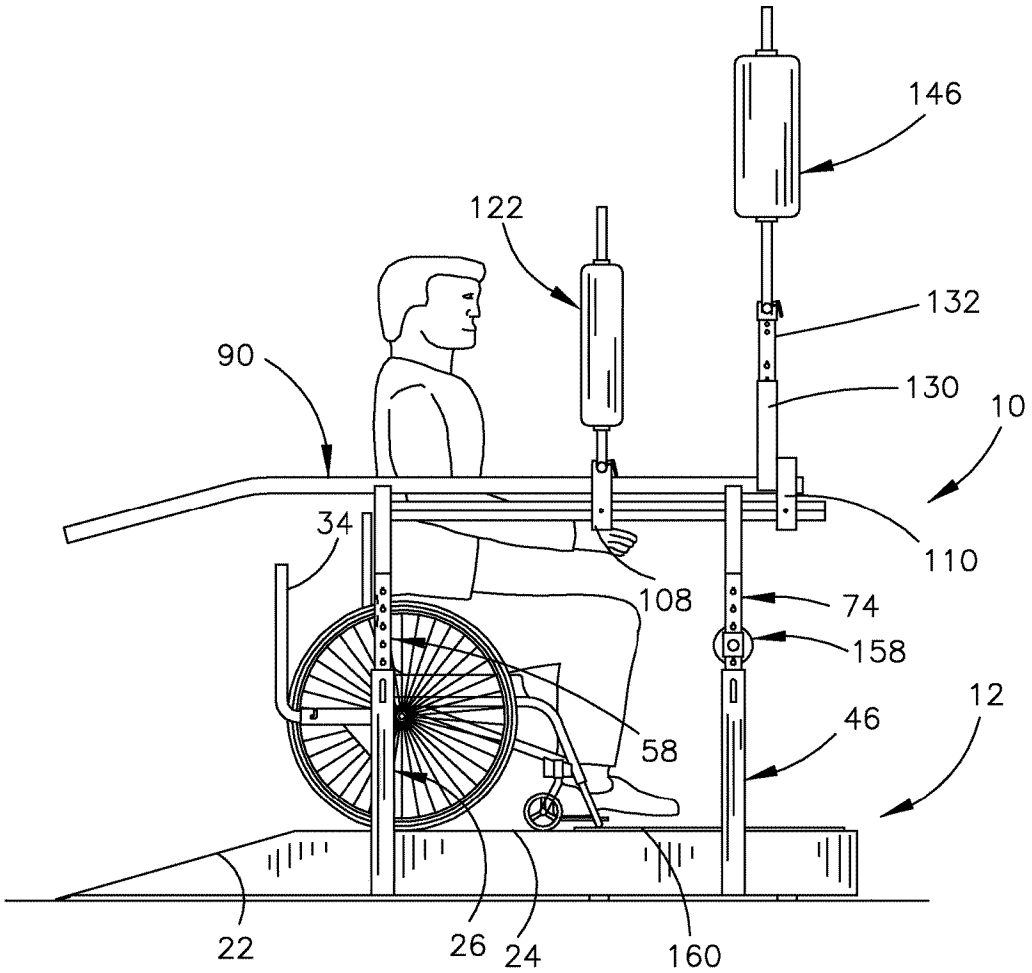

A first vertically disposed support tube 26 has its lower end secured to side 18 of platform 12 forwardly of the upper end of ramp 22. The upper end of support tube 26 has a pin opening 28 extending therethrough which is adapted to receive a retaining pin 30 therein. A horizontally disposed tube 32 has its forward end secured to support tube 26, by welding, below the upper end of support tube 26. The numeral 34 refers to a first gate arm which has its one end pivotally received by the rearward end of tube 32. Gate arm 34 is selectively pivotally movable between an inwardly extending horizontally disposed position (FIGS. 1 and 5) and an upwardly extending vertical position (FIG. 8).

A second vertically disposed support tube 36 has its lower end secured to side 20 of platform 12 forwardly of the upper end of ramp 22. The upper end of support tube 36 has a pin opening 38 extending therethrough which is adapted to receive a retaining pin 40 therein. A horizontally disposed tube 42 has its forward end secured to support tube 36, by welding, below the upper end of support tube 36. The numeral 44 refers to a second gate arm which has its one end pivotally received by the rearward end of tube 42. Gate arm 44 is selectively pivotally movable between an inwardly extending horizontally disposed position (FIGS. 1 and 5) and an upwardly extending vertical position. Means is provided for maintaining gate arms 34 and 44 in their horizontal and vertical positions.

A third vertically disposed support tube 46 has its lower end secured to side 18 of platform 12 rearwardly of the forward end 14 of platform 12. The upper end of support tube 46 has a pin opening 48 formed therein which is adapted to receive a retaining pin 50 therein. A fourth vertically disposed support tube 52 has its lower end secured to side 20 of platform 12 rearwardly of the forward end 14 of platform 12. Support tube 52 has pin opening 54 formed therein which is adapted to receive a retaining pin 56 therein.

The numeral 58 refers to a first hand rail support arm which includes a vertically disposed lower end portion 60 and an inclined upper end portion 62 which extends upwardly and inwardly from the upper end of lower end portion 60. Lower end portion 60 is selectively vertically adjustably and slidably received in the upper end of support tube 26 and has a plurality of vertically spaced-apart pin openings 64 formed therein which are adapted to receive retain pin 30 therein.

The numeral 66 refers to a second hand rail support arm which includes a vertically disposed lower end portion 68 and an inclined upper end portion 70 which extends upwardly and inwardly from the upper end of lower end portion 68. Lower end portion 68 is selectively vertically adjustably and slidably received in the upper end of support tube 36 and has a plurality of vertically spaced-apart pin openings 72 formed therein which are adapted to receive retaining pin 40 therein.

The numeral 74 refers to a third hand rail support arm which includes a vertically disposed lower end portion 76 and an inclined upper end portion 78 which extends upwardly and inwardly from the upper end of lower end portion 76. Lower end portion 76 is selectively vertically adjustably and slidably received in the upper end of support tube 46 and has a plurality of vertically spaced-apart pin openings 80 formed therein which are adapted to receive retaining pin 50 therein.

The numeral 82 refers to a fourth hand rail support arm which includes a vertically disposed lower end portion 84 and an inclined upper end portion 86 which extends upwardly and inwardly from the upper end of lower end portion 84. Lower end portion 84 is selectively vertically adjustably and slidably received in the upper end of support tube 52 and has a plurality of vertically spaced-apart pin openings 88 formed therein which are adapted to receive retaining pin 56 therein.

The numeral 90 refers to a first elongated first handrail having a forward end 92 and a rearward end 94. The upper ends of upper end portions 62 and 78 of handrail supports 58 and 74 respectively are welded to handrail 90. The numeral 96 refers to a second handrail having a forward end 98 and a rearward end 100. The upper ends of upper end portions 70 and 86 of handrail supports 66 and 82 respectively are welded to handrail 96.

An elongated and horizontally disposed slide bar 102 has its rearward end 104 welded to upper end portion 62 of handrail support 58 below the upper end of upper end portion 62. Slide bar 102 is welded to upper end portion 78 of handrail support 74 and has its forward end 106 positioned forwardly of upper end portion 78. Slide members 108 and 110 are selectively slidably adjustably mounted on slide bar 102 as seen in the drawings.

An elongated and horizontally disposed slide bar 112 has its rearward end 114 welded to upper end portion 70 of handrail support 66 below the upper end of upper end portion 70. Slide bar 112 is welded to upper end portion 86 of handrail support 82 and has its forward end 116 positioned forwardly of upper end portion 86. Slide members 118 and 120 are slidably adjustably mounted on slide bar 112.

The numeral 122 refers to a first restraint member having a cylindrical portion 124 with shafts 126 and 128 extending outwardly from the ends of cylindrical portion 124. Shaft 128 is pivotally secured to the upper end of support member 118. Shaft 128 is selectively locked into the upper end of support member 108. Restraint member 122 is selectively pivotally movable between vertical and horizontal positions.

The lower end of a vertically disposed support tube 130 is secured to slide member 110 and has a support tube 132 selectively vertically adjustably received therein as seen in the drawings. A lock block 134 is mounted on the upper end of support tube 132.

The lower end of a vertically disposed support tube 136 is secured to slide member 120 and has a support tube 138 selectively vertically adjustably received therein as seen in the drawings. A block or saddle 140 is mounted on the upper end of support tube 138. Shafts 142 and 144 extend outwardly from the ends of a cylindrical restraint member 146. Shaft 144 is selectively pivotally secured to block 140. Shaft 142 is selectively locked into lock block 134. Restraint member 146 is selectively pivotally movable between a vertically disposed position and a horizontally disposed position.

A sleeve or collar 148 is selectively vertically adjustably mounted on lower end portion 76 of handrail support 74. A retractably plunger or pin 150 locks sleeve 148 in various vertical positions on lower end portion 76. A sleeve or collar 152 is similarly selectively vertically adjustably mounted on lower end portion 84 of handrail support 82. The shafts 154 and 156 of a cylindrical restraint member 158 are welded to sleeves 148 and 152 respectively.

The numeral 160 refers to a vibrating pad which is embedded in platform portion 24 and which is connected to a suitable power source in a conventional manner.

The instant invention is used as illustrated in FIGS. 8-12. Initially, the gate arms 34 and 44 will be in their vertically disposed positions. The restraint member 122 will be in the vertically disposed position as seen in FIG. 8. At that same time, patient restraint member 146 will normally be in its vertically disposed position as also seen in FIG. 8, but the restraint member 146 could be in its horizontally disposed position. The first and second handrails will usually have been adjusted upwardly or downwardly in anticipation of the particular patient who uses the invention. Additionally, the restraint member 158 will have been vertically adjusted in anticipation of the forthcoming patient.

Figure 10:
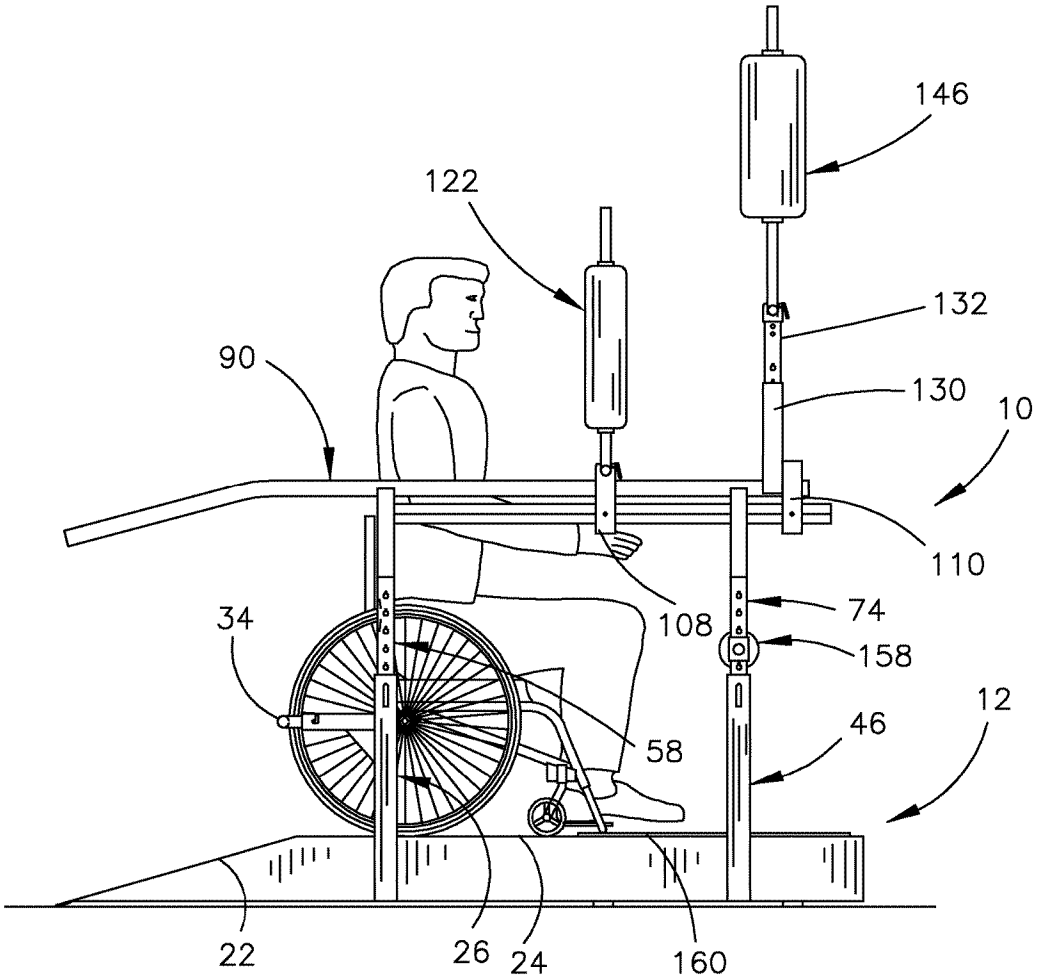
Figure 11:
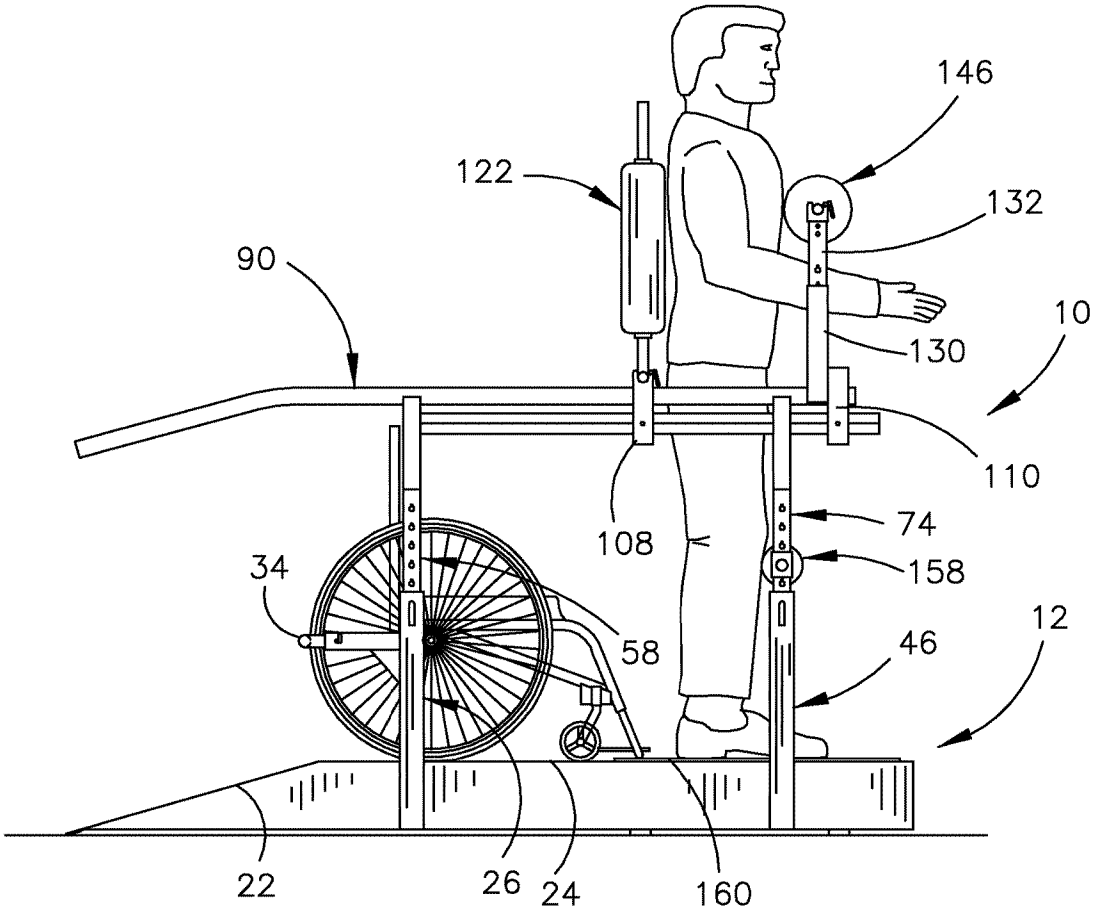
Figure 12:
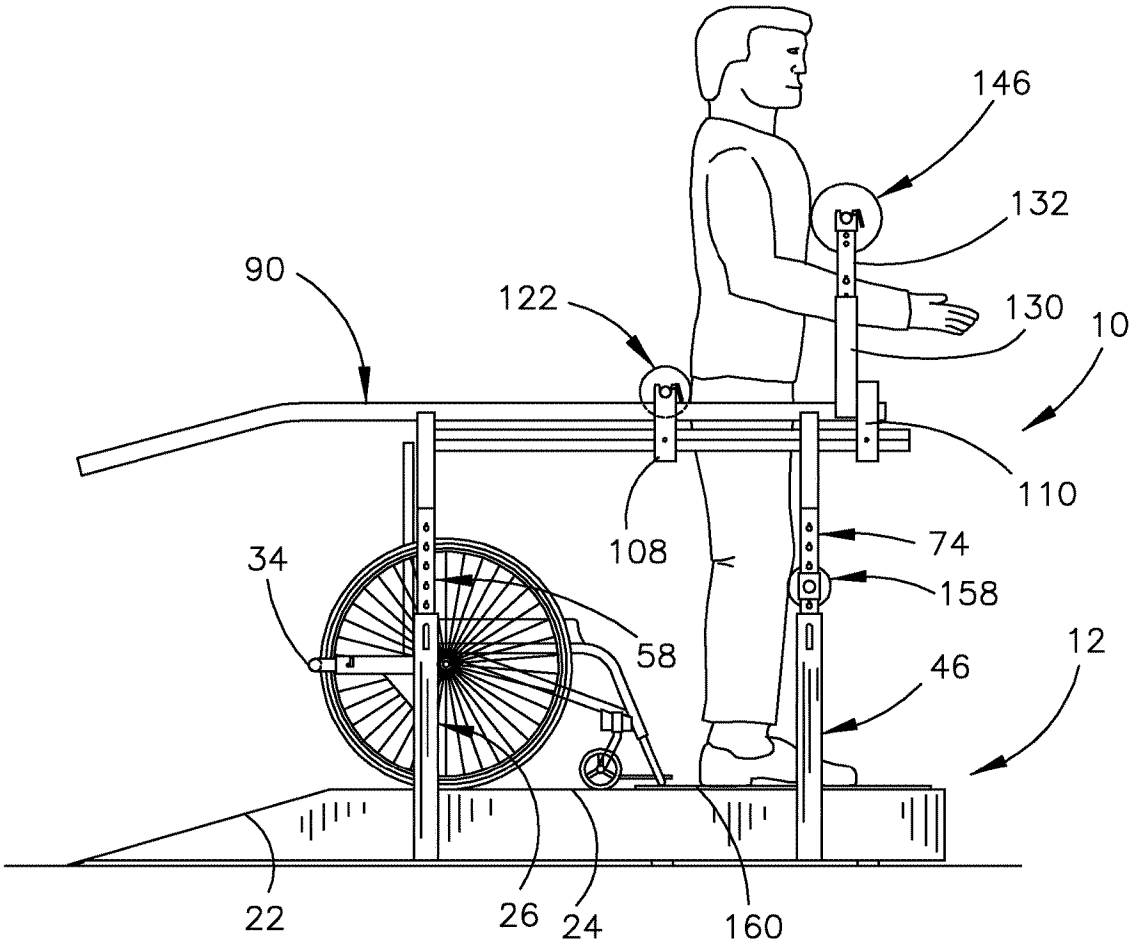

The patient rolls his/her wheelchair upwardly onto the ramp 22 and will pass through the vertically disposed gate arms 34 and 44 (FIG. 8). When the wheelchair patient has moved onto the platform portion 24 (FIG. 9), the patient or attendant will lower the gate arms 34 and 44 to prevent the wheelchair from moving rearwardly from the platform portion 24 (FIG. 10). The patient or an attendant will then lower restraint member 146 to its horizontally disposed position. The patient will then stand up so that the patient's chest abuts against restraint member 158 (FIG. 11) and so that the patient's legs abut against restraint member 158 (FIG. 11). At that time, the patient or attendant will lower restraint member 132 to its horizontal position rearwardly of the patient (FIG. 12). The patient or attendant will then energize the vibration pad 160 so that the patient will be subjected to vibration to increase the bone density of the patient's legs, etc. The apparatus of this invention is primarily designed to increase the bone density of the patient but is believed to increase blood flow and muscle mass. The invention also provides exercise for the patient and improves the digestive system of the patient.

When the patient's treatment has been concluded, the restraint member 122 is moved to its vertically disposed position to enable the patient to sit in his/her wheelchair. The gate arms 34 and 44 are then opened to permit the patient to roll rearwardly from the platform.

Thus it can be seen that the invention accomplishes at least all of its stated objectives.

Although the invention has been described in language that is specific to certain structures and methodological steps, it is to be understood that the invention defined in the appended claims is not necessarily limited to the specific structures and/or steps described. Rather, the specific aspects and steps are described as forms of implementing the claimed invention. Since many embodiments of the invention can be practiced without departing from the spirit and scope of the invention, the invention resides in the claims hereinafter appended.

We claim:

1. An apparatus for increasing the bone density of a patient, comprising:

a raised platform having a forward end, a rearward end, a first side and a second side;

said platform including an inclined ramp portion at said rearward end thereof with said ramp portion having a rearward lower end and a forward upper end;

said platform also including a horizontally disposed platform portion, having rearward and forward ends, which extends horizontally from said forward upper end of said ramp portion;

a horizontally disposed vibrating pad embedded in said horizontally disposed platform portion adjacent said forward end of said horizontally disposed platform portion;

an upstanding first support tube having upper and lower ends;

said lower end of said first support tube being secured to said platform at said first side thereof at said rearward end of said horizontally disposed platform portion;

an upstanding second support tube having upper and lower ends;

said lower end of said second support tube being secured to said platform at said second side thereof adjacent said rearward end of said horizontally disposed platform portion;

an upstanding third support tube having upper and lower ends;

said lower end of said third support tube being secured to said first side of said platform at said forward end of said horizontally disposed platform portion;

an upstanding fourth support tube having upper and lower ends;

said lower end of said fourth support tube being secured to said second side of said platform adjacent said forward end of said horizontally disposed platform portion;

a first safety arm pivotally secured to said first support tube below said upper end thereof;

said first safety arm being selectively pivotally movable between open and closed positions;

said first safety arm, when in said closed position, extending inwardly towards said second side of said platform;

a second safety arm pivotally secured to said second support tube below said upper end thereof;

said second safety arm being selectively pivotally movable between open and closed positions;

said second safety arm, when in said closed position, extending inwardly towards said first side of said platform;

a first handrail support having a vertically disposed lower end portion and an inclined upper end portion;

said lower end portion of said first handrail support being selectively vertically adjustably received by said upper end of said first support tube;

a second handrail support having a vertically disposed lower end portion and an inclined upper end portion;

said lower end portion of said second handrail support being selectively vertically adjustably received by said upper end of said second support tube;

a third handrail support having a vertically disposed lower end portion and an inclined upper end portion;

said lower end of said third handrail support being selectively vertically adjustably received by said upper end of said third support tube;

a fourth handrail support having a vertically disposed lower end portion and an inclined upper end portion;

said lower end portion of said fourth handrail support being selectively vertically adjustably received by said upper end of said fourth support tube;

an elongated first handrail having first and second ends;

said first handrail being secured to said upper end portions of said first and third handrail supports;

an elongated second handrail having first and second ends;

said second handrail being secured to said upper end portions of said second and fourth handrail supports;

an elongated and horizontally disposed first slide bar having rearward and forward ends;

said rearward end of said first slide bar being secured to said first handrail support;

said first slide bar being secured to said third handrail support so that said forward end of said first slide bar extends forwardly beyond said third handrail support;

an elongated and horizontally disposed second slide bar having rearward and forward ends;

said rearward end of said second slide bar being secured to said second handrail support;

said second slide bar being secured to said fourth handrail support so that said forward end of said second slide bar extends forwardly beyond said fourth handrail support;

a first slide member selectively longitudinally adjustably slidably mounted on said first slide bar between said first and third handrail supports;

a second slide member selectively longitudinally adjustably slidably mounted on said first slide bar forwardly of said third handrail support;

a third slide member selectively longitudinally adjustably slidably mounted on said second slide bar between said second and fourth handrail supports;

a fourth slide member selectively longitudinally adjustably slidably mounted on the said second slide bar forwardly of said fourth handrail support;

a horizontally disposed first patient restraint member having first and second ends;

said first end of said first patient restraint member being secured to said first slide member;

said second end of said first patient restraint member being secured to said third slide member;

an upstanding fifth support tube having upper and lower ends;

said lower end of said fifth support tube being secured to said second slide member;

an upstanding sixth support tube having upper and lower ends;

said lower end of said sixth support tube being secured to said fourth slide member;

a horizontally disposed second patient restraint member having first and second ends;

said first end of said second patient restraint member being operatively vertically adjustably secured to said fifth support tube;

said second end of said second patient restraint member being operatively vertically adjustably secured to said sixth support tube;

a third horizontally disposed patient restraint member having first and second ends;

said first end of said third patient restraint member being selectively vertically adjustably secured to said lower end portion of said third handrail support;

said second end of said third patient restraint member being selectively vertically adjustably secured to said lower end portion of said fourth handrail support.

2. An apparatus for increasing the bone density of a patient, comprising:

a raised platform having a forward end, a rearward end, and a first side and a second side;

said platform including an inclined ramp portion at said rearward end thereof with said ramp portion having a rearward lower end and a forward upper end;

said platform also including a horizontally disposed platform portion, having rearward and forward ends, which extends horizontally from said forward upper end of said ramp portion;

a horizontally disposed vibrating pad embedded in said horizontally disposed platform portion adjacent said forward end of said horizontally disposed platform portion;

an upstanding first side frame having upper and lower ends, a rearward end and a forward end;

said lower end of said first side frame being secured to said platform at said first side thereof;

an upstanding second side frame having upper and lower ends, a rearward end and forward end;

said lower end of said second side frame being secured to said platform at said second side thereof;

a first elongated handrail having forward and rearward ends;

said first handrail being secured to said upper end of said first side frame;

a second elongated handrail having forward and rearward ends;

said second handrail being secured to said upper end of said second side frame;

a first horizontally disposed patient restraint member secured to and extending between said forward ends of said first and second side frames above said platform below said forward ends of said first and second handrails;

a second horizontally disposed patient restraint member secured to and extending between said forward ends of said first and second side frames above said forward ends of said first and second handrails;

and a third horizontally disposed patient restraint member secured to and extending between said first and second side frames rearwardly of said forward ends thereof.

3. The apparatus of claim 2 wherein each of said first and second handrails are selectively vertically adjustably mounted on said first and second side frames respectively.

4. The apparatus of claim 2 wherein said first restraint member is selectively vertically adjustably mounted on said first and second side frames.

5. The apparatus of claim 2 wherein said second restraint member is selectively vertically adjustably mounted on said first and second side frames.

6. The apparatus of claim 2 wherein said third restraint member is selectively movable between a horizontally disposed position and a vertically disposed position.

7. The apparatus of claim 2 wherein said third restraint member is selectively horizontally adjustably mounted on said first and second side frames.

8. The apparatus of claim 2 wherein said rearward ends of said first and second side frames with each end having a safety arm secured thereto which is movable between horizontally disposed positions to vertically disposed positions.

* * * * *